United States Patent [19]

Benedict

[11] 3,964,523

[45] June 22, 1976

[54] SHUTTLE DRIVE LINKAGE FOR LOOMS

[75] Inventor: Charles E. Benedict, Tallahassee, Fla.

[73] Assignee: Wayne H. Coloney Co., Inc., Tallahassee, Fla.

[22] Filed: Dec. 12, 1974

[21] Appl. No.: 532,119

[52] U.S. Cl. ..... 139/142; 74/40; 74/43

[51] Int. Cl.[2] ..... D03D 49/24

[58] Field of Search ..... 139/142–149, 139/133, 123, 127 R; 74/40, 43, 469

[56] References Cited

UNITED STATES PATENTS

| | | | |
|---|---|---|---|
| 535,827 | 3/1895 | Gzoon | 74/40 |
| 2,328,466 | 8/1943 | Krzenciessa et al. | 74/40 |
| 3,391,714 | 7/1968 | Quintana | 139/123 |
| 3,794,085 | 2/1974 | Stephens | 139/142 X |

FOREIGN PATENTS OR APPLICATIONS

| | | | |
|---|---|---|---|
| 578,000 | 6/1933 | Germany | 74/40 |
| 181,226 | 3/1936 | Switzerland | 139/142 |
| 633,809 | 12/1949 | United Kingdom | 139/146 |
| 635,954 | 4/1950 | United Kingdom | 139/146 |

*Primary Examiner*—James Kee Chi
*Attorney, Agent, or Firm*—A. Yates Dowell, Jr.

[57] ABSTRACT

An apparatus mounted on a weaving loom for moving a weft thread carrying mechanism from one end of a loom lay to the other through the shed of the warp threads. The apparatus includes a linkage having a drive mechanism which is rotated continuously and which maintains the weft thread carrying mechanism in a fixed position for an extended dwell period and then propels the weft thread carrying mechanism across the lay after the lay has beat up a prior weft thread and has been retracted to an inoperative position. The apparatus provides a substantial reduction in the noise level and power requirement over conventional looms and permits the speed of operation to be increased to improve production.

11 Claims, 12 Drawing Figures

SHUTTLE DRIVE LINKAGE FOR LOOMS

BACKGROUND OF THE INVENTION

1. Field of the Invention.

This invention relates generally to weaving loom mechanisms and relates particularly to apparatus for moving a weft thread carrying mechanism through the shed of a multiplicity of warp threads.

2. Description of the Prior Art.

Heretofore, in substantially all power operated weaving looms, a multiplicity of warp threads have been provided which extend from front to rear of the loom and normally such warp threads extend through harnesses on which is mounted a heddle for each of the warp threads. The harnesses are independently movable so that the heddles of certain of the warp threads are in raised position and the heddles of the other warp threads are in a lowered position with the angle between the upper and lower threads defining the shed of the cloth being woven. A loom lay is provided having a raceway and a reed or comb and such lay normally is carried by a pair of swingably mounted swords. The opposite ends of the lay usually include a shuttle box and such boxes receive and declerate a shuttle or missle which is thrown from one end of the lay to the other.

The shuttle or missile either carries or is connected to a weft thread or filler so that when the shuttle or missile is thrown along the raceway of the lay, the weft thread is placed in the shed of the warp threads. When the weft thread is in place, the lay is swung toward the front of the loom to cause the reed to beat up the weft thread after which the lay is retracted to an inoperative position and at least some of the heddles which have been in a raised position are lowered and at least some of the heddles which have been in a lowered position are raised. After the heddles have been operated, the shuttle or missile is operated to place another weft thread in the shed of the warp thread and the beat-up operation is repeated.

Most shuttles of fly shuttle looms are driven by a picker stick having a pick head at one end for engaging the end of the shuttle and the opposite end of such picker stick normally is mounted on a foot mechanism located at the base of the swords which permits swinging movement of the picker stick in multiple directions. A check strap ordinarily engages the picker stick adjacent to the lay and a lug strap normally engages the picker stick intermediate the lay and the foot mechanism. In order to drive the picker stick to cause the shuttle to be propelled from one end of the lay to the other, the lug strap is swingably connected to an oscillating shaft the opposite ends of which are journaled in bearings carried by the frame of the loom. A cam follower is rotatably mounted on a follower arm which is fixed to the oscillating shaft and such cam follower normally engages a cam driven from a power plant on the loom.

Usually the cam has a relatively short toe portion which extends for approximately 19° of rotation of the cam, and the remaining periphery of the cam includes a follower return portion and a dwell portion. When the cam follower engages the toe portion of the cam, the shaft is oscillated rapidly in one direction which causes the lug strap to slap against the picker stick and swing the picker stick inwardly and move the upper end of the picker stick through the check strap while throwing the shuttle from one end of the lay to the other. Ordinarily, the movement of the cam follower system and the picker sticks to throw the shuttle across the lay occurs while the lay is moving back and forth of the loom. The shaking, banging, slapping and other related movements of the shuttle drive mechanism have not only created substantial noise directly, but have caused sound producing vibrations to occur in many of the parts including the picker stick so that a noise level which is detrimental to humans has been created within weaving rooms.

Since there is a cam operated picker stick at each end of the lay, only one picker stick is operated for each beat-up motion of the lay and, therefore, the cam drive mechanisms are operated at half the speed of the lay drive mechanism. Although the cam and follower system is relatively slow in terms of pure speed, it is normally regarded as a high-speed cam system because of the mass of the cam and follower system, picker stick and drive mechanism and the inertia forces which are involved. Also the power consumption has been large due to the size of the power plant necessary to overcome the various forces as well as to drive the loom at a speed of approximately 178 picks per minute.

In missile type looms, the weft thread is connected to a relatively small missile and such missile is thrown from one end of the lay to the other through the shed of the warp threads. In order to throw the missile, a lever is fixed at one end to a torsion bar and the other end of such lever is swingably connected to a connecting link which in turn is connected to a pick shoe which engages the missile. The lever normally is engaged by a cam which applies a torque to the torsion bar and moves the pick shoe to a cocked position. When the lever is released, the torsion bar causes the pick shoe to throw the missile to the opposite end of the lay. Normally in missile type looms, a plurality of missiles are provided and each missile has a clamping mechanism for engaging the weft thread. When the weft thread has been attached to the missile, such missile is placed in front of the pick shoe after the pick shoe has been cocked and the missile is thrown from one side of the lay to the other. When the missile has traversed the lay, the clamping mechanism is released and the missile is returned to the first side of the loom through a return channel which is spaced from the lay. In this type of loom, the weft thread is placed in the shed from one side only and is not moved back and forth as in the fly shuttle loom.

Some efforts have been made to eliminate the cam drive mechanism of fly shuttle and missile type looms by providing linkages of various kinds for driving the shuttle or missile of the weft thread carrying mechanism from one end of the lay to the other while the lay is immobile; however, an extended dwell period normally is required to permit the lay to be advanced and retracted for the beat-up operation, as well as to permit time for the harnesses carrying the heddles to be operated so that the desired warp threads can be shifted. In most of the prior art structures, it has been difficult to provide a dwell period in excess of approximately 180° of rotation of the drive mechanism.

Some examples of prior art structures which include linkages are the patents to Schwabe U.S. Pat. No. 540,878; Kellogg et al U.S. Pat. No. 2,066,532; and Dyer U.S. Pat. No. 3,270,779.

SUMMARY OF THE INVENTION

The present invention is embodied in a linkage mechanism for intermittently throwing a shuttle or missile from one side of the lay to the other while the linkage is being driven substantially continuously and which is provided with a dwell period in excess of 250° of rotation of the linkage drive. When the apparatus is used on a fly shuttle loom, a picker stick is mounted at each end of the lay and such picker sticks are adapted to be driven by cooperating four-bar linkages arranged in a manner that both of the picker sticks remain in a retracted position during most of the rotation of the linkage drive. However, one or both of the picker sticks are operated during a short portion of the linkage drive to throw the shuttle from one side of the lay to the other through the shed of the warp threads. In another embodiment, the pick head which engages the shuttle is mounted on a track carried by the lay and is connected to a cable or chain in such a manner that the four-bar linkages drive the cable or chain to propel the shuttle after an extended dwell period. When the apparatus is used on a missile type loom, the cooperating four-bar linkages are arranged in a manner to directly or indirectly drive the pick shoe so that such pick shoe propels the missile from one side of the lay to the other.

It is an object of the invention to provide a shuttle or missile throwing apparatus driven by a specific linkage and in which the linkage is being driven continuously while providing a substantially non-moving dwell period in excess of 250° of rotation of the linkage drive.

Another object of the invention is to provide an apparatus for moving a weft thread carrying mechanism across the lay of a weaving loom which substantially reduces the noise level and power requirements of the loom while increasing the production rate thereof.

DESCRIPTION OF THE PREFERRED EMBODIMENTS

Figure 1:
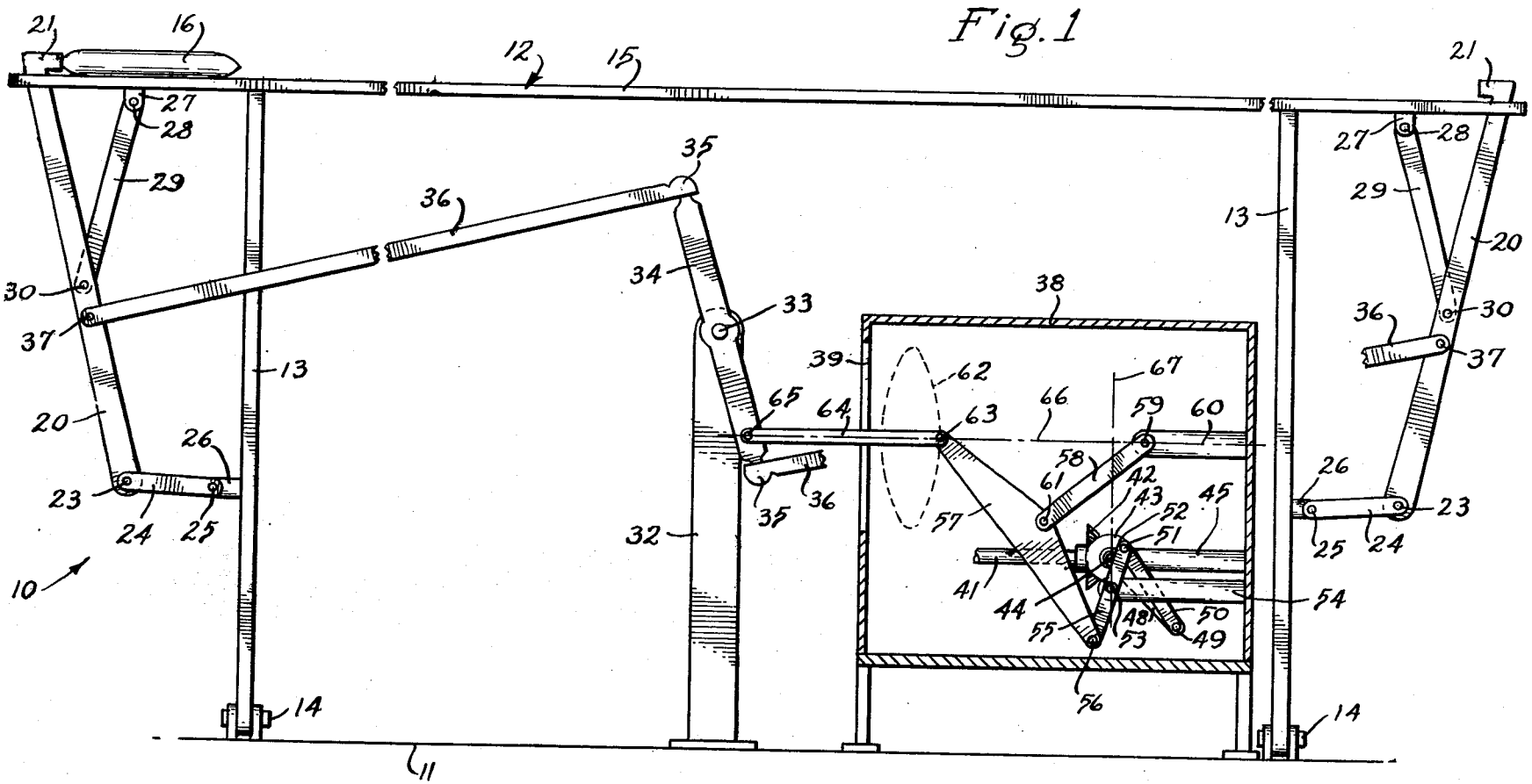
FIG. 1 is a side elevation illustrating one embodiment of the shuttle drive linkage.

With continued reference to the drawings, a fly shuttle type weaving loom 10 is provided having a frame 11 on which a lay 12 is mounted on a pair of upright generally parallel swords 13 which are swingably mounted about pivots 14. The lay 12 includes a raceway or bed 15 and a multiplicity of upwardly extending fingers (not shown) forming a reed or comb to beat up the weft thread after the weft thread has been placed in the shed of the warp threads. Such lay is adapted to be extended and retracted to operative and inoperative positions in any conventional manner (not shown). As illustrated in FIG. 1, a shuttle 16 is movably mounted on the raceway 15 and such shuttle normally carries a bobbin of filler thread, one strand of which is paid out each time the shuttle is thrown from one end of the raceway to the other. Although a conventional shuttle has been illustrated, it is noted that any conventional weft thread carrying apparatus, such as a missile, rapier, or the like, can be used for placing a weft thread in the shed of the warp threads.

With particular reference to FIGS. 1–6, a picker stick 20 having a pick head 21 is located at each end of the lay 12 and such picker stick extends upwardly through a slot 22 adjacent each end of the lay raceway. Preferably the picker sticks 20 are substantially shorter than conventional picker sticks and weigh substantially less so that inertia forces are easier to overcome. In order for each pick head to move in a substantially straight line path to cause the shuttle 16 to be thrown at a relatively high velocity from one end of the raceway to the other, the lower end of the picker stick is swingably connected by a pivot 23 to one end of a link 24 and the opposite end of such link is connected by a pivot 25 to a lug 26 carried by a sword 13.

A lug 27 is carried by the raceway 15 and such lug is connected by a pivot 28 to a link 29 the opposite end of which is connected by a pivot 30 to the picker stick 20. The pivot 28 is substantially in vertical alignment with the pivot 23 so that upward movement of the pick head 21 caused by swinging the picker stick through an arc about the pivot 23 is counteracted by the link 29 which causes the pivot 23 to move downwardly a distance substantially corresponding to the upward arcuate movement of the picker stick and thereby cause the pick head to travel in a substantially straight line.

In order to reduce power requirements for driving the picker sticks 20, an upstanding post 32 is mounted on the frame 11 and the upper end of such post is connected by a pivot 33 to the central portion of a lever 34. Each end of the lever 34 is connected by a pivot 35, such as a ball and socket type joint, to a pitman or connecting link 36 and the opposite ends of such connecting links are connected by pivots 37 to the picker sticks 20 at opposite ends of the lay 12. The pivots 37 which join the connecting links to the picker sticks are generally in horizontal alignment with the pivot 33 of the post so that swinging movement of the lever 34 causes equal and opposite movement of both picker sticks simultaneously.

In order to swing the lever 34 about the pivot 33 and operate the picker sticks 20, a housing 38 having an elongated slot 39 is mounted on the frame 11 in spaced relationship to the post 32. A drive shaft 41, which is drivingly connected to the conventional power plant of the loom, extends into the housing 38 and such shaft is provided with a bevel gear or other speed reducer 42. A driven bevel gear 43 is rotatably mounted within the housing 38 and meshes with the drive gear 42 so that the driven gear is rotated by the loom power plant. The driven gear 43 is supported in any desired manner, as by a shaft 44 journaled in a post 45 supported by the housing 38. It is contemplated that a separate variable speed power plant (not shown) could be provided for driving the shaft 41 in synchronized relationship with the remaining portions of the loom.

One end of a drive crank 48 is fixed either directly to the driven gear 43 or to the shaft 44 so that rotation of the driven gear causes rotation of the drive crank 48. The opposite end of the drive crank is connected by a pivot 49 to one end of a drag link 50 and the opposite end of such drag link is connected by a pivot 51 to one end of a follower 52. The opposite end of the follower 52 is adjustably connected to a shaft 53 which is rotatably supported by a post 54 within the housing 38 in such a manner that the drive crank 48, drag link 50, follower 52, and the housing 38 form a double crank four-bar linkage which is driven by the loom power plant.

At the opposite end of the shaft 53, a driven crank 55 is adjustably mounted and such driven crank can be disposed at any desired angle relative to the follower 52, although, as illustrated, the driven crank and the follower extend extend radially from opposite sides of the longitudinal axis of the shaft 53. The opposite end of the driven crank 55 is connected by a ppivot 56 to one end of a triangular shaped coupler 57. A rocker 58 is provided having one end connected by a pivot 59 to a post 60 carried by the housing 38. The opposite end of the rocker 58 is swingably connected by a pivoted 61 to an intermediate point on the coupler 57 so that the free end of the coupler defines a generally elliptical coupler curve 62.

The free end of the coupler 57 is swingably connected by a pivot 63 to one end of a pitman or drive link 64 which extends through the slot 39 in the housing and the opposite end of such pitman is connected by a pivot 65 to the lever 34. The length of the pitman or drive link 64 between the pivot 63 and the pivot 65 corresponds generally to the radius of one side of the coupler curve 62 defined by the free end of the coupler 57. The driven crank 55, coupler 57, rocker 58, and the housing 38 form a crank-rocker four-bar linkage which is interconnected with the double-crank four-bar linkage by the shaft 54 in such a manner that the crank-rocker four-bar linkage is driven by the double-crank four-bar linkage.

The rocker pivot 59 and the drive link pivot 65 are located along a plane indicated by the dot-dash line 66. The centers of rotation of the shaft 44 and the shaft 53 are in alignment with each other along the plane indicated by the dot-dash line 67 which is generally normal to the plane 66 and is spaced from the rocker pivot 59.

Figure 2:
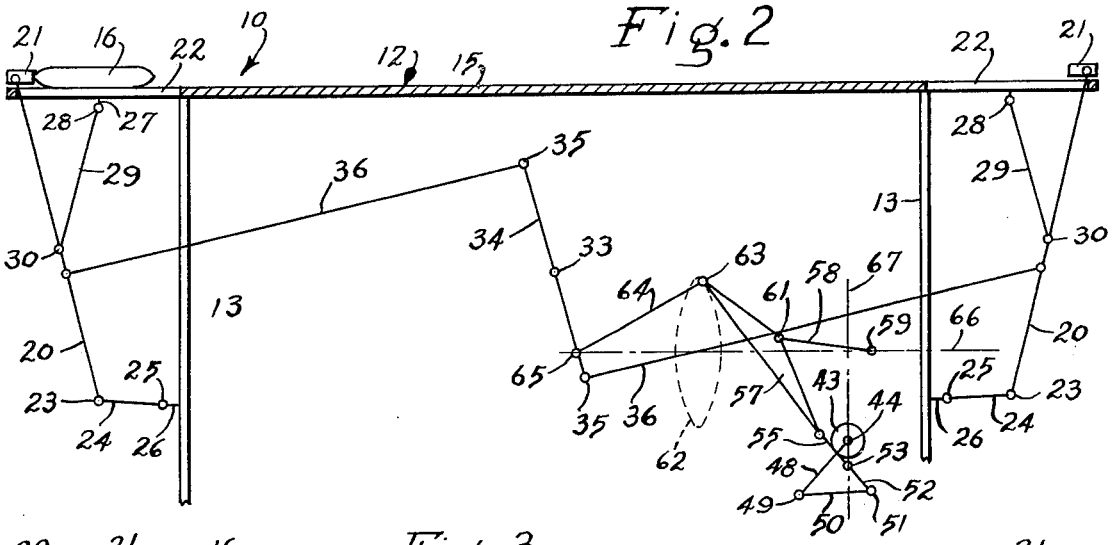
FIG. 2 is a schematic side elevation illustrating the apparatus in a position to begin the movement of the shuttle throwing mechanism.
Figure 3:
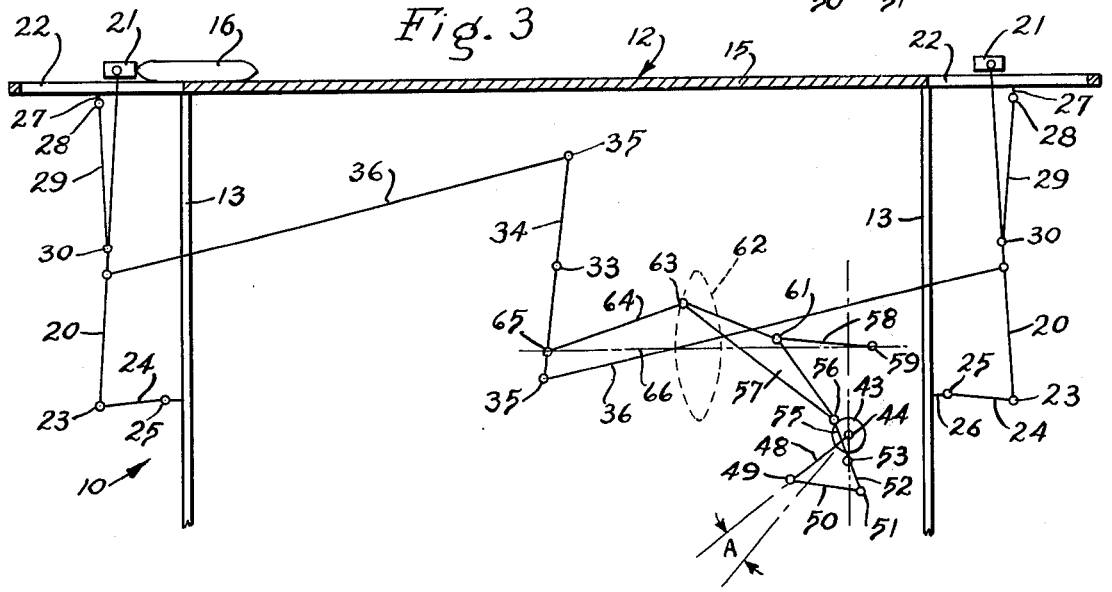
FIG. 3 is a schematic side elevation similar to FIG. 2 illustrating the position of the linkages at the approximate point of maximum velocity of the shuttle.
Figure 4:
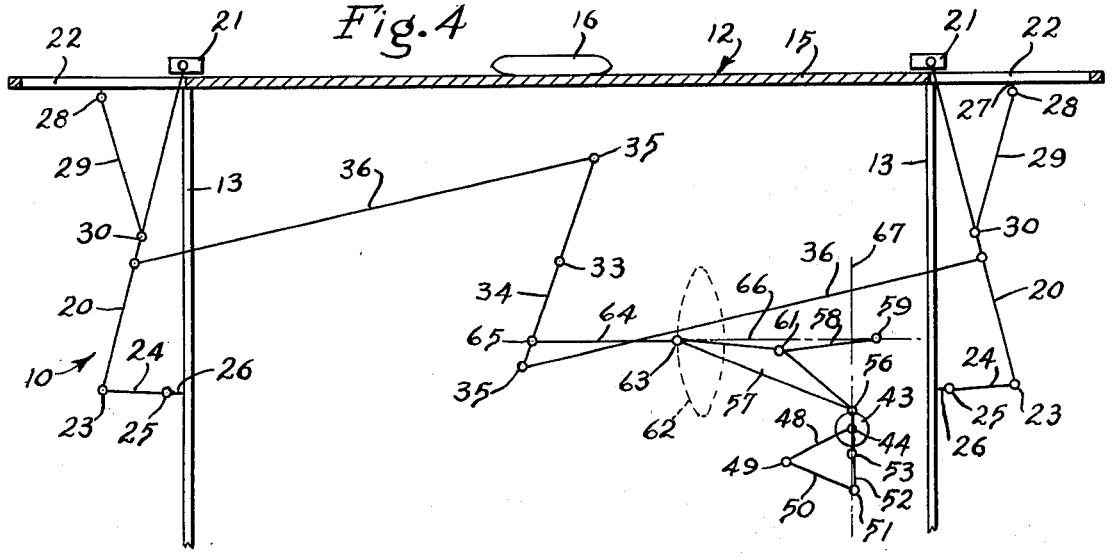
FIG. 4 is a schematic similar to FIG. 2 illustrating the innermost position of the shuttle throwing mechanism.

In this arrangement of four-bar linkages, the picker sticks 20 remain in substantially fixed retracted positions during most of the rotation of the drive crank 48. As illustrated in FIG. 2, the picker sticks 20 are in retracted position when the drive crank 48 reaches a position substantially halfway through the lower lefthand quadrant of its rotation. As illustrated in FIG. 3, when the drive crank has passed through an angle A of approximately 10° and is still in the lower lefthand quadrant, both picker sticks have been swung inwardly and have reached substantially maximum velocity and the shuttle is still in engagement with the pick head 21 of the lefthand picker stick. With reference to FIG. 4, both picker sticks have reached their innermost positions and have come to a stop while the shuttle is in free flight across the raceway 15 of the lay.

Figure 5:
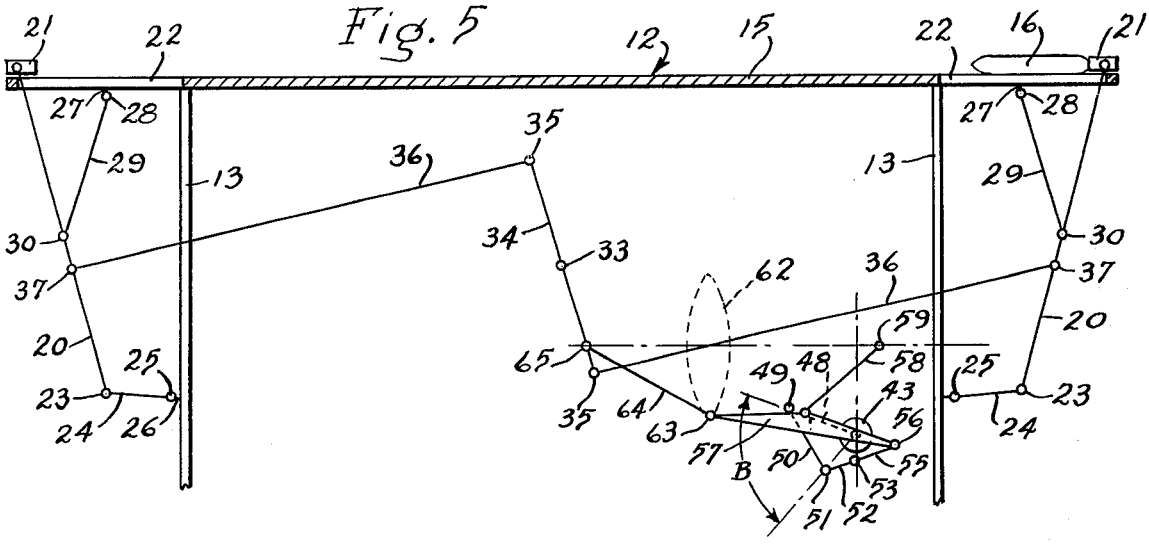
FIG. 5 is a schematic similar to FIG. 2 illustrating the shuttle throwing mechanism after it has been returned to retracted position.

With reference to FIG. 5, the drive crank 48 has moved to the upper lefthand quadrant of its rotation and the picker sticks 20 have been returned to their retracted outermost positions. In this figure, the angle B represents approximately 70° of rotation and includes the total angle of movement of the drive crank 48 to advance and retract the picker sticks. Just before the picker sticks reach the fully retracted position, the flying shuttle engages the pick head 21 of the righthand picker stick while such picker stick is still moving outwardly. Accordingly, the impact related noise, as well as the attendant vibrations, are substantially reduced since the impact is absorbed by the moving pick head and picker stick.

Figure 6:
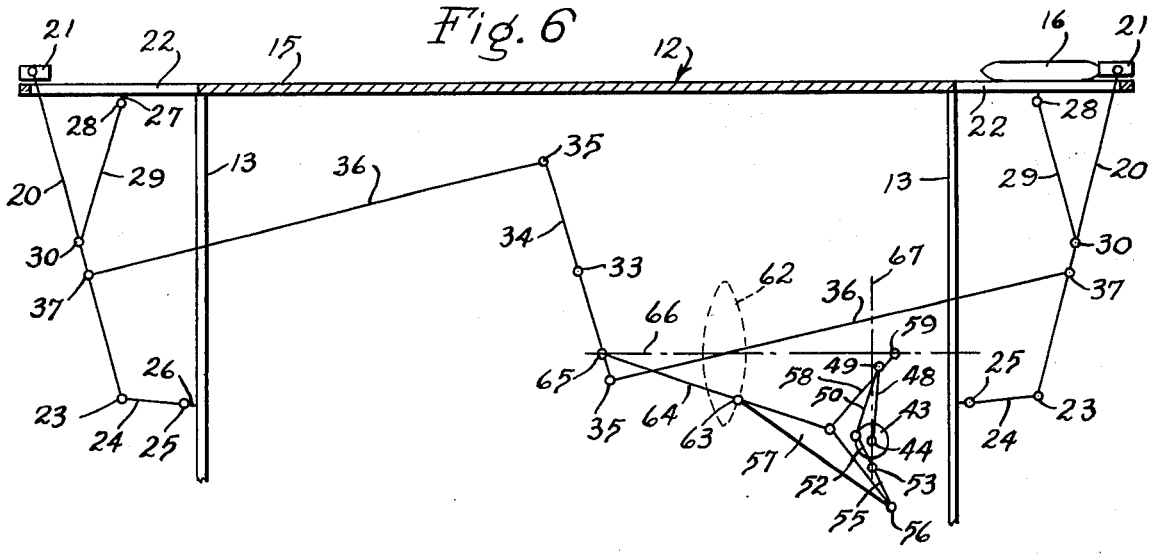
FIG. 6 is a schematic similar to FIG. 2 illustrating one position of the linkages during the dwell portion of the shuttle throwing mechanism.

As illustrated best in FIGS. 1 and 6, after the picker sticks have been returned to their outermost positions, the drive crank 48 rotates through approximately 290° of rotation from the position shown in FIG. 5 to the position shown in FIG. 2 without causing any substantial movement of the picker sticks since the pitman 64 is of a length equal to the radius of the righthand side of the coupler curve 62. During this 290° rotation of the drive crank, the lay 12 is advanced so that the reed carried thereby beats up the weft thread placed in the shed of the warp threads by the passage of the shuttle 16 across the lay. Thereafter the lay is retracted and stopped in a predetermined position while the harnesses of the loom again are operated to change the relative positions of the warp threads.

Figure 7:
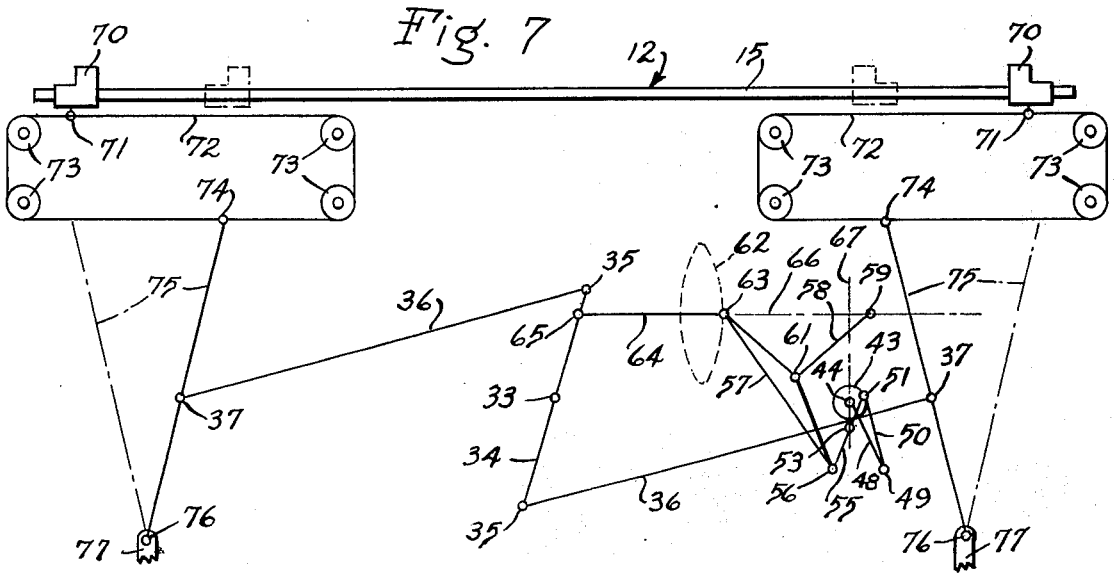
FIG. 7 is a schematic side elevation illustrating another embodiment of the invention.

With particular reference to FIG. 7, a pick head 70 is provided which can be slidably mounted on the lay 12 or can be slidably carried by a track (not shown) supported by the lay. The pick head 70 is provided with a downwardly extending lug 71 which is connected to the upper run of an endless cable or chain 72 carried by a plurality of freely rotatable sheaves or sprockets 73. The lower run of the cable 72 is connected by a pivot 74 to the upper end of a lever 75 the lower end of which is connected by a pivot 76 to a post 77 supported by the frame 11. In this embodiment, the connecting links 36 are joined to the levers 75 by the pivots 37. If desired, the pivots 37 between the connecting links 36 and the levers 75 may be adjustable to regulate the length of travel of the pick head 70 along the lay.

It is contemplated that the connecting links 36 may be connected directly to the cables 72 at opposite ends of the lay since the lengths of the connecting links 36 make little or no difference because the amount of travel of the pick heads 70 is governed by the length of movement of the pivots 35 at opposite ends of the lever 34. The amount of movement of the lever 34 may be controlled by adjusting the position of the pivot 65 relative to the central pivot 33 of the lever as long as the pivot 65 retains its radial position relative to the coupler curve 62.

Figure 8:
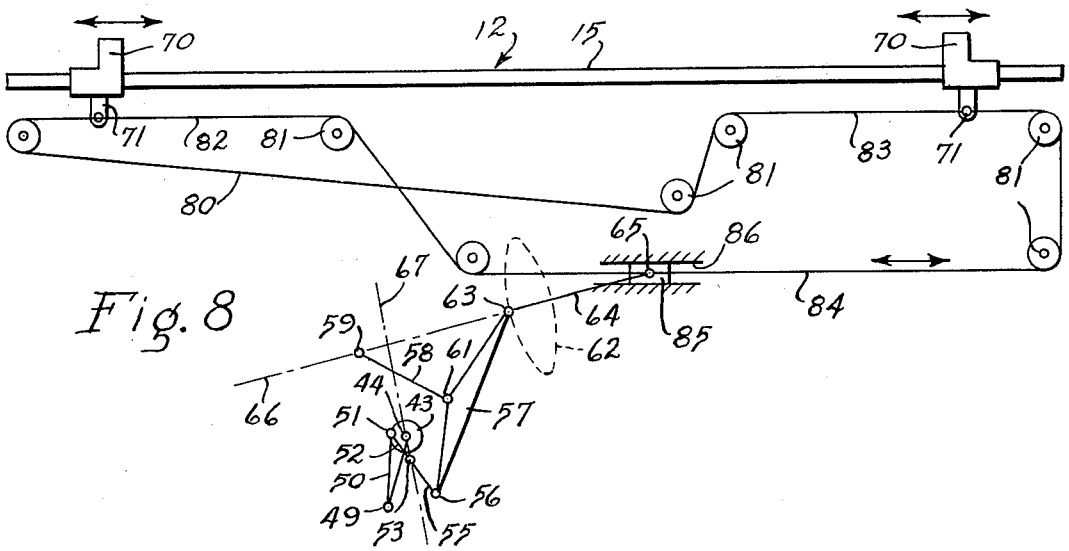
FIG. 8 is a schematic side elevation illustrating a further embodiment of the invention.
Figure 9:
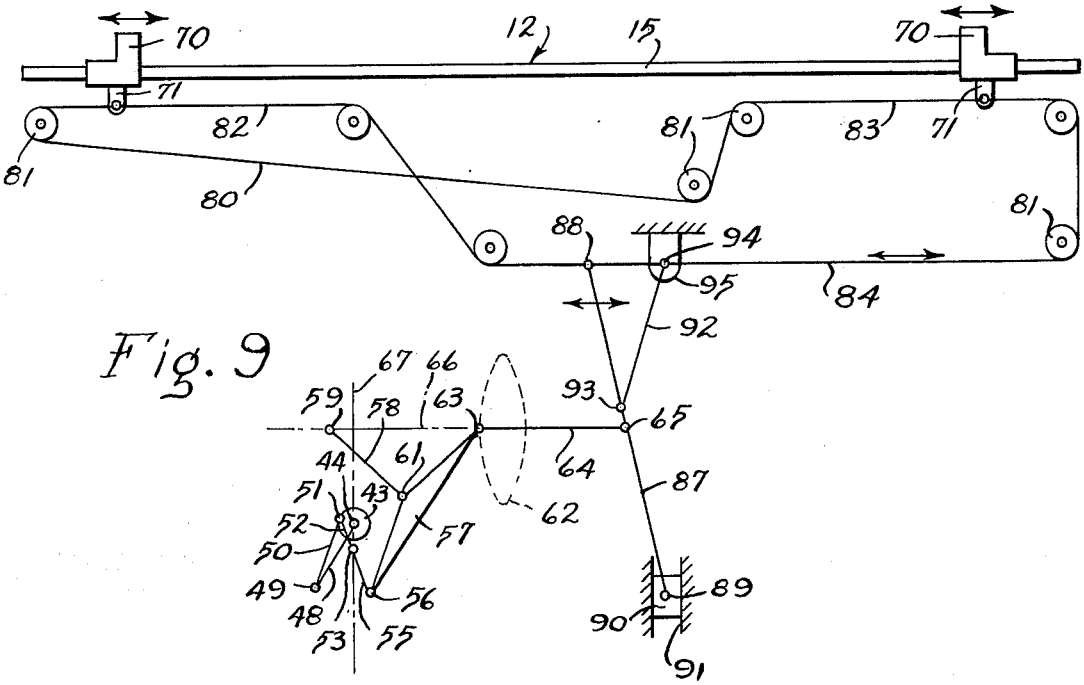
FIG. 9 is a schematic side elevation similar to FIG. 8 and illustrating a different type of linkage.
Figure 10:
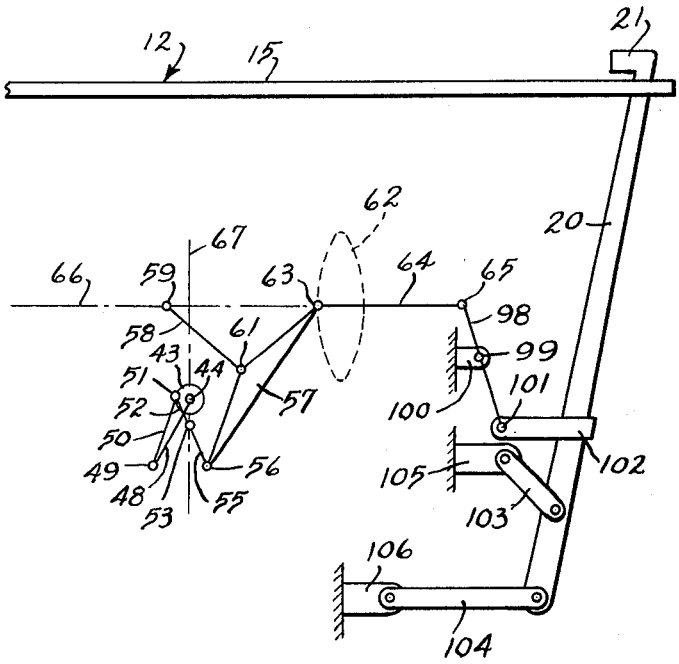
FIG. 10 is a schematic side elevation of one end of the lay and illustrating an independent drive linkage.

With reference to FIGS. 8–10, the previously described double-crank four-bar linkage and the crank-rocker four-bar linkage remain the same, while the apparatus for driving the pick head to cause the shuttle to be thrown from end to end of the lay has been modified. As illustrated in FIG. 8, the pick heads 70 may be slidably mounted at each end of the lay or may be mounted in a track (not shown) beside the lay and each of such pick heads has a downwardly extending lug 71. An endless cable or chain 80 extends around a plurality of pulleys or sprockets 81 in such a manner that a pair of upper runs 82 and 83 and a lower run 84 are provided. The upper runs 82 and 83 are connected to the downwardly extending lugs 71 of the pick heads at opposite ends of the lay and the lower run 84 is connected to a slider 85 mounted within a track 86 located adjacent to such lower run.

The pivot 65 at the end of the pitman or drive link 64 is connected to the slider 85 so that such slider has substantially no movement during approximately 290° of rotation of the drive crank 48. During the remaining 70° of rotation of the drive crank, the slider 85 is initially moved toward the right in FIG. 8 and subsequently is returned to the starting position. This movement causes both of the pick heads 70 to initially move toward the center of the lay so that one pick head throws the shuttle after which the pick heads move toward the opposite ends of the lay. The thrown shuttle engages the other pick head while such other pick head is moving in the same direction as the shuttle and therefore any impact related noise is substantially reduced.

With reference to FIG. 9, in order to vary the throw or movement of the pick heads 70, the pitman or drive link 64 is not connected to the slider 85 but instead the pivot 65 is movably mounted along the length of a lever 87. One end of the lever is connected by a pivot 88 to the lower run 84 of the cable or chain 80 and the other end of such lever is connected by a pivot 89 to a vertically disposed slider 90 mounted in a track 91. In order to move the pivot 88 in a substantially straight horizontal direction, a link 92 has one end connected by a pivot 93 to the lever 87 and the opposite end of such link is connected by a pivot 94 to a lug 95 fixed to the frame 11 of the loom. The pivot 94 is located substantially in the same plane as the lower run 84 of the cable 80. The lever 87, slider 90 and link 92 constitute a variable multiplier for controlling the amount of movement of the pick heads 70.

With reference to FIG. 10, an arrangement is provided for driving the picker stick 20 at only one end of the lay. If desired a similar linkage could be provided at the other end of the lay for driving the other picker stick in timed relationship with the picker stick shown in FIG. 10. In this embodiment the pivot 65 of the pitman or drive link 64 is connected to one end of a lever 98. Such lever 98 is swingably mounted intermediate its ends on a pivot 99 carried by a lug 100 fixed to the frame 11 and the opposite end of such lever is connected by a pivot 101 to one end of a lug strap 102 of conventional construction. The lug strap 102 normally surrounds the picker stick intermediate the ends of such picker stick with sufficient play to permit slight movement of the picker stick. In this embodiment the lower end of the picker stick is mounted on a pair of links 103 and 104 and such links are swingably connected to lugs 105 and 106, respectively, carried by the frame 11 of the loom.

With this construction, when the pitman or drive link 64 is moved to the right during the initial portion of the 70° of rotation of the drive crank, the lug strap 102 is moved toward the left in FIG. 10 so that the pick head 21 is moved toward the center of the lay. When this occurs the links 103 and 104 cause the pick head 21 at the upper end of the picker stick 20 to move in a substantially straight generally horizontal line. During the latter portion of the 70° of rotation of the drive crank, the pick head is returned to the position illustrated in FIG. 10 where it stays for the remaining 290° of the drive crank.

In the operation of the embodiments illustrated in FIGS. 1–10, the fly shuttle loom pick heads 21 or 70 at opposite ends of the lay 12 in FIGS. 1–9 are operated simultaneously each time the shuttle 16 is thrown from one side of the lay to the other, while the pick heads 21 in FIG. 10 may be operated independently in timed relationship with each other. When the drive shaft 41 is operated, the drive gear 42 rotates the driven gear 43 at a desired speed to drive the double-crank four-bar linkage. The double-crank four-bar linkage causes the shaft 53 to rotate and drive the crank-rocker four-bar linkage so that the free end of the coupler 57 follows a generally elliptical path or coupler curve. During approximately 290° of rotation of the drive crank 48, the pivot 63, which connects one end of the drive link 64 to the free end of the coupler 57, defines one side of the elliptical coupler curve as such pivot moves from the position shown in FIG. 5 to the position shown in FIG. 2. During this time, the pivot 65 at the other end of the pitman or drive link 64 remains substantially immobile since such pitman or drive link is of a length substantially equal to the radius of the coupler curve 62.

When the free end of the coupler 57 has reached the position illustrated in FIG. 2, further rotation of the drive crank 48 initially causes the pick heads 21 or 70 to move inwardly. Within approximately 10° of rotation of the drank crank 48, the shuttle is accelerated to a free flight velocity and leaves the pick head to place a weft thread in the shed of the warp threads of the loom. As soon as the shuttle leaves the pick head, the pick heads 21 or 70 are subjected to a controlled deceleration until the pick heads reach the innermost position illustrated in FIG. 4. In this position the pick heads come to a momentary stop and immediately begin to accelerate in an outward direction.

As the pick heads are moving outwardly, the flying shuttle catches up with the outwardly moving pick head at the opposite end of the lay; however, since the shuttle and the pick head are moving at substantially the same speed, any impact related noise and vibration are substantially reduced. When the shuttle has engaged the pick head at the opposite end of the lay, the pick heads are rapidly decelerated as the pivot 63 and the free end of the coupler 57 pass through the lower portion of the coupler curve 62 to the position illustrated in FIG. 5. Continued rotation of the drive crank 48 causes the free end of the coupler to follow the side of the coupler curve 62 which results in no movement of the pick heads as previously described. During this time, the lay 12 is advanced to beat up the weft thread placed in the shed of the warp threads by the passage of the shuttle, after which the lay is retracted to its inoperative position, the harnesses are operated to shift the relative positions of the warp threads, and the operation is repeated.

Figure 11:
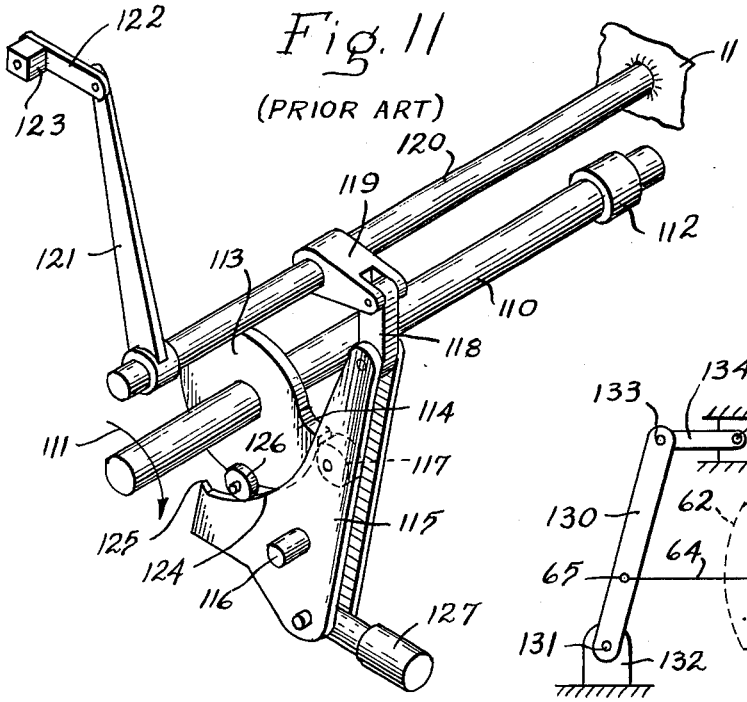
Fig. 11 (PRIOR ART)
FIG. 11 is a perspective view illustrating the prior art used in a missile type loom.
Figure 12:
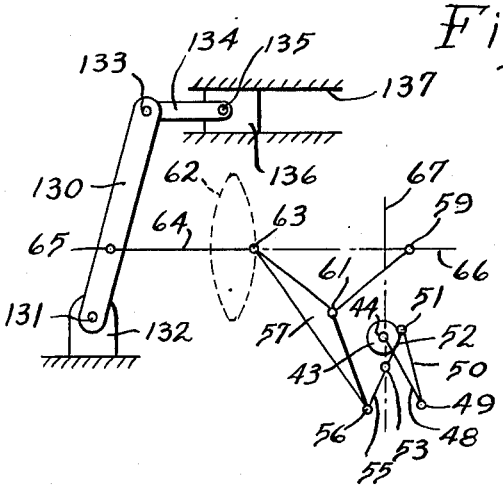
FIG. 12 is a schematic side elevation of a drive linkage used in a missile type loom.

With particular reference to FIGS. 11 and 12, a missile type loom is provided in which a relatively small missile is attached to a weft thread and is thrown from one side of the lay to the other. In this type of loom, the weft thread bobbin is not carried by the missile and only the end of the weft thread is connected thereto with the result being that the missile is thrown in one direction only and is returned by a separate path.

Normally most conventional missile type looms use a torsion bar propulsion system such as that illustrated in FIG. 11. In this structure, a drive shaft 110 is rotated in a clockwise direction, as indicated by the arrow 111, and such drive shaft normally is rotatably mounted in two or more bearings 112. A cam 113 having a cam toe 114 is fixed to the drive shaft 110 and rotated thereby. A rocker 115 is swingably mounted on a shaft 116 and such rocker carries a cam follower wheel 117. The upper end of the rocker is swingably connected to one end of a connecting link 118 and the opposite end of such connecting link is swingably connected to a lug 119 which is welded or otherwise secured in fixed position to the intermediate portion of a torsion bar 120.

One end of the torsion bar 120 is splined, welded, or otherwise fixed to the frame 11 of the loom and the free end of such torsion bar is secured to an upstanding pick arm 121. A drag link 122 is swingably connected at one end to the upper end of the pick arm and the other end of such drag link is connected to a pick shoe 123 which is slidably mounted on the lay of the loom (not shown), or if desired can be mounted within a track adjacent to the lay. A missile to which the weft thread has been connected, is placed on the lay in engagement with the pick shoe after the pick shoe has been moved to a cocked position, as will be described hereinafter.

The rocker 115 has a cam surface 124 terminating in an upwardly extending inclined surface or spur 125. The cam 113 has a trigger roller 126 rotatably mounted thereon in a position to substantially follow the cam surface 124 into engagement with the spur 125 when the pick arm 121 is in cocked position. A shock absorbing dash pot 127 is located adjacent to the lower end of the rocker 115.

In order to cock the pick arm 121, the drive shaft 110 is rotated in a clockwise direction, as shown in FIG. 11, so that the cam 113 and cam toe 114 engage the follower wheel 117 on the rocker and move the rocker in a clockwise direction. Movement of the rocker causes the connecting link 118 to twist the outer end of the torsion bar 120 in a counterclockwise direction until the pivotal connection between the rocker 115 and the link 118 passes an imaginary line drawn between the shaft 116 and the pivotal connection between the link 118 and the lug 119 and locks the torsion bar 120 in cocked position. In this position the missile is placed in front of the pick shoe 123 while the cam toe 114 clears the cam follower wheel 117.

Continued rotation of the drive shaft 110 causes the trigger roller 126 to engage the spur 125 and swing the rocker 115 in a counterclockwise direction until the pivotal connection between the connecting link 118 and the rocker 115 passes the dead center imaginary line and releases the pent-up torque of the torsion bar 120. The pent-up energy of the torsion bar causes rapid swinging movement of the pick arm 121, drag link 122 and pick shoe 123 and causes the missle to reach full flight velocity. After the missile has been thrown the dash pot 127 absorbs the energy of the rocker and maintains the rocker in a position where the cam 113 and cam toe 114 engage the follower wheel 117 to again cock the torsion bar 120 when the drive shaft is rotated.

In order to eliminate the torsion bar propulsion system which is described, particular attention is directed to FIG. 12. In this embodiment, the double-crank four-bar linkage and the crank-rocker four-bar linkage, as previously described in connection with FIGS. 1–10, remain the same. A pick arm 130 is connected by a pivot 131 at one end to a lug 132 carried by the frame 11 of the loom. The opposite end of the pick arm is connected by a pivot 133 to a drag link 134 the opposite end of which is connected by a pivot 135 to a pick shoe 136 slidably mounted within a track 137.

The pivot 65 and the outer end of the drive link 64 are connected to the pick arm 130 intermediate the ends thereof so that a missile (not shown) can be placed in front of the pick shoe 136 at any time during approximately 290° of rotation of the drive crank 48 and during the remaining 70° of rotation of such drive crank the pick arm 130 is swung rapidly from right to left, as illustrated in FIG. 12, to propel the missile across the lay and then the pick arm is moved from left to right to return the pick shoe 136 to retracted or "cocked" position. In this construction the pick shoe remains in "cocked" position during most of the rotation of the drive shaft and the drive crank and therefore the time for placing the missile in front of the pick shoe is not critical as in the prior art in which the missile must be placed in front of the pick shoe within a few degrees of rotation of the drive shaft.

Due to the reduced mass of the picker sticks and related structure, as well as the fact that in most cases both picker sticks are operated simultaneously so that the impact between the shuttle and the pick head is substantially reduced, the driven gear 43 can be operated at a speed sufficient to drive the shuttle at over 200 picks per minute. Accordingly, the present structure not only substantially reduces the power requirements and the noise level of the loom over conventional structure, but also permits the apparatus to move at a faster rate to increase production.

I claim:

1. In a weaving loom having a frame, a lay mounted on a pair of swords which are swingably mounted on said frame, a pick head movably mounted on at least one end of said lay, and a weft thread carrying member adapted to be thrown from one end of said lay to the other by said pick head, the improvement comprising a housing, a drive crank rotatably supported within said housing, means for continuously driving said crank at a substantially constant speed, a drag link rotatably connected at one end to said drive crank and rotatably connected at the other end to a follower, said follower being fixed to a shaft rotatably mounted within said housing, a driven crank fixed to said shaft and rotated thereby, an elongated coupler swingably connected at one end to said driven crank and the other end of said coupler being free to move, a rocker swingably connected at one end to said housing and swingably connected at the other end to an intermediate portion of said coupler so that the free end of said coupler moves in an elliptical coupler curve when said driven shaft is rotated, drive link means swingably connected at one end to the free end of said coupler, said drive link means having a length corresponding generally to the radius of one side of said coupler curve, and means drivingly connecting the other end of said drive link means to the pick head, whereby rotation of said drive crank causes the free end of said coupler to follow a first half of the coupler curve during most of the rotation and causes the free end of said coupler to follow a second half of the coupler curve during the remaining portion of the rotation of said drive crank to extend and retract said drive link means and the pick head.

2. The structure of claim 1 in which the free end of said coupler moves through the first half of the coupler curve during more than 200° of rotation of said drive crank.

3. The structure of claim 1 in which the free end of said coupler moves through the first half of said coupler curve during substantially 290° of rotation of said drive crank and moves through the second half of the coupler curve during substantially 70° of rotation of said crank.

4. The structure of claim 1 in which said means drivingly connecting the other end of said drive link means to the pick head includes swingably mounted lever means, the other end of said drive link means being swingably connected to said lever means, and means connecting said lever means to the pick head.

5. The structure of claim 1 in which said means drivingly connecting the other end of said drive link means to the pick head includes cable means, and said cable means being connected to said pick head.

6. A drive linkage for moving a pair of pick heads along the lay of a weaving loom toward each other and away from each other and providing an extended dwell period between certain of the movements, comprising a first fourbar linkage having a drive crank, means for driving said crank at a substantially constant speed, a second four-bar linkage connected to said first four-bar linkage and driven thereby, said second four-bar linkage including a driven crank, a coupler having a first end rotatably connected to said driven crank and a second end which moves along an elliptical coupler curve when said second linkage is driven, swingably mounted lever means located near the second end of said coupler, means connecting the opposite ends of said lever means to said pick heads, a drive link connecting the second end of said coupler to said lever means, and said drive link being of a length equal to the radius of one side of said coupler curve, whereby said first and second four-bar linkages cause the second end of said coupler to move through a first portion of the coupler curve during most of the rotation of said drive crank without moving said lever means and cause the second end of said coupler to move through a second portion of the coupler curve during the remaining portion of rotation of said drive crank to cause said link to swing said lever means to advance and retract said pick heads.

7. The structure of claim 6 in which said first four-bar linkage is a double-crank four-bar linkage and said second four-bar linkage is a crank-rocker four-bar linkage.

8. The structure of claim 6 in which the connection between said first four-bar linkage and said second four-bar linkage includes a shaft rotatably mounted on said loom.

9. The structure of claim 6 in which the pick heads are mounted on picker sticks swingably mounted at each end of the lay.

10. The structure of claim 9 in which each of said picker sticks is swingably supported by a second link carried by said loom, and a third link swingably connects each picker stick to the lay of said loom, whereby the pick head of each picker stick is moved in a substantially straight line.

11. The structure of claim 6 in which said pick heads are connected to cable means at each end of the lay, and the cable means are drivingly connected to said lever means.

* * * * *